US005414877A

United States Patent [19]

Tsai et al.

[11] Patent Number: 5,414,877

[45] Date of Patent: May 16, 1995

[54] FLUSH DEVICE FOR WATER CLOSET

[76] Inventors: Pang-Yen Tsai; Chien-Liang Hsiao, both of Suite 1, 11F, 95-8 Chang Ping Road, Sec. 1, Taichung, Taiwan, Prov. of China

[21] Appl. No.: 106,283

[22] Filed: Aug. 13, 1993

[51] Int. Cl.[6] ..... E03D 1/22

[52] U.S. Cl. ..... 4/325; 4/415; 4/412

[58] Field of Search ..... 4/324, 325, 415, 412, 4/405, 411, 413, 414

[56] References Cited

U.S. PATENT DOCUMENTS

| | | | |
|---|---|---|---|
| 1,605,938 | 11/1926 | Haas | 4/412 |
| 4,141,092 | 2/1979 | Jones | 4/324 |
| 4,620,331 | 11/1986 | Sagucio | 4/325 |
| 4,837,867 | 6/1989 | Miller | 4/324 |
| 4,969,218 | 11/1990 | Comparetti | 4/324 |
| 5,191,661 | 3/1993 | Chang | 4/324 |

*Primary Examiner*—Henry J. Recla

*Assistant Examiner*—Gregory M. Vidovich

[57] ABSTRACT

A flush device for water closets comprising an overflow tube, a flush lever, a handle connected to a first end of the flush lever, a flapper ball, a connecting device and a lever restraining device. The connecting device comprises a support guide having a rod member having its first end connected to a ring member which is affixed to the overflow tube, and its second end connected to a pulley, a long robe is looped onto the pulley having at first end connected to the flapper ball and the second end connected to a second end of the flush lever via the pulley, a short robe having at first end connected to the flapper ball and the second end connected to the second end of said flush lever. The lever restraining device being in a form of an angular restrainer has a ring connector attached to the overflow tube, a right-angled stop rod at a first side of the ring connector, and a positioning screw at a second side of the ring connector. This device controls the amount of the flush water discharged.

1 Claim, 6 Drawing Sheets

FLUSH DEVICE FOR WATER CLOSET

BACKGROUND OF THE PRESENT INVENTION

The present invention relates to water closets, more particularly to an improved flush device for water closets which can be lifted to different levels via the robes and pulley to provide a multi-staged flush means for controlling the amount of flush water discharged.

Similar devices known from the prior art employ a ball cock and float ball; when water reaches a certain level, the float ball then closes a fill valve in the ball cock via the float rod. A flush valve is controlled by a flush lever connected to a flapper ball which automatically closes the flush valve upon the receding of the water level.

The disadvantage of such flush device of the prior art lies in its lack of flexibility to adjust the amount of discharge of flush water, such that every time when this flush device is activated, a tankful of water is discharged regardless of whether such large amount of flush water is needed. Since there are many occasions when smaller amount of flush water is sufficient, a two-staged flush system to save water is also known from the prior art.

As shown in FIG. 1, a prior art two-staged flush system has a duplicate set of flush devices including another flush valve installed at mid-tank level apparently requiring an additional flush rod, lift chain and handle. To install another handle, this design of the prior art also requires drilling another hole in the wall of the water tank, which is a difficult task to accomplish because the water tank is usually made of ceramic materials and easily broken.

Further, the water tank may not be big enough to accommodate two sets of flush device. Alternatively, a new water tank prefabricated to fit an additional set of flush devices would be uneconomical.

SUMMARY OF THE INVENTION

The main object of the present invention is to provide a flush device for water closet which can control the amount of flush water discharged.

Accordingly, the present invention provides:

A flush device for water closets, comprising an overflow tube, a flush lever, a handle connected to a first end of the flush lever, a flapper ball, a connecting means and a lever restraining means.

The connecting means comprises a support guide, a pulley, a long robe and a short robe. The support guide has a rod member having its first end connected to a ring member which is affixed to the overflow tube, and having its second end connected to the pulley. The long robe is looped onto said pulley and having its first end connected to the flapper ball and its second end connected to a second end of the flush lever. The short robe has its first end connected to the flapper ball and its second end connected to the second end of the flush lever.

The lever restraining means is in a form of an angular restrainer having a ring connector attached to said overflow tube, a right-angled stop rod at a first side of the ring connector, and a positioning screw at a second side of said ring connector wherein the position screw connects the ring member to the overflow tube.

The flush handle is operable in a first direction and a second opposite direction to open the flapper ball via the short robe and the long robe, respectively, controlling the amount of flush water discharged.

DETAILED DESCRIPTION OF THE PREFERRED EMBODIMENT OF THE PRESENT INVENTION

Figure 1:
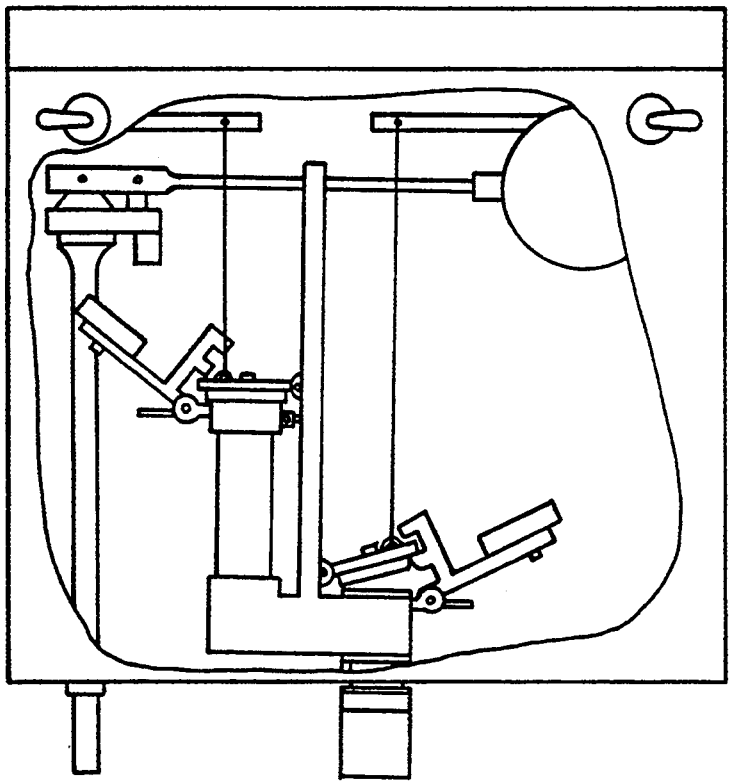
FIG. 1 PRIOR ART
FIG. 1 is schematic diagram of an example known from the prior art.
Figure 2:
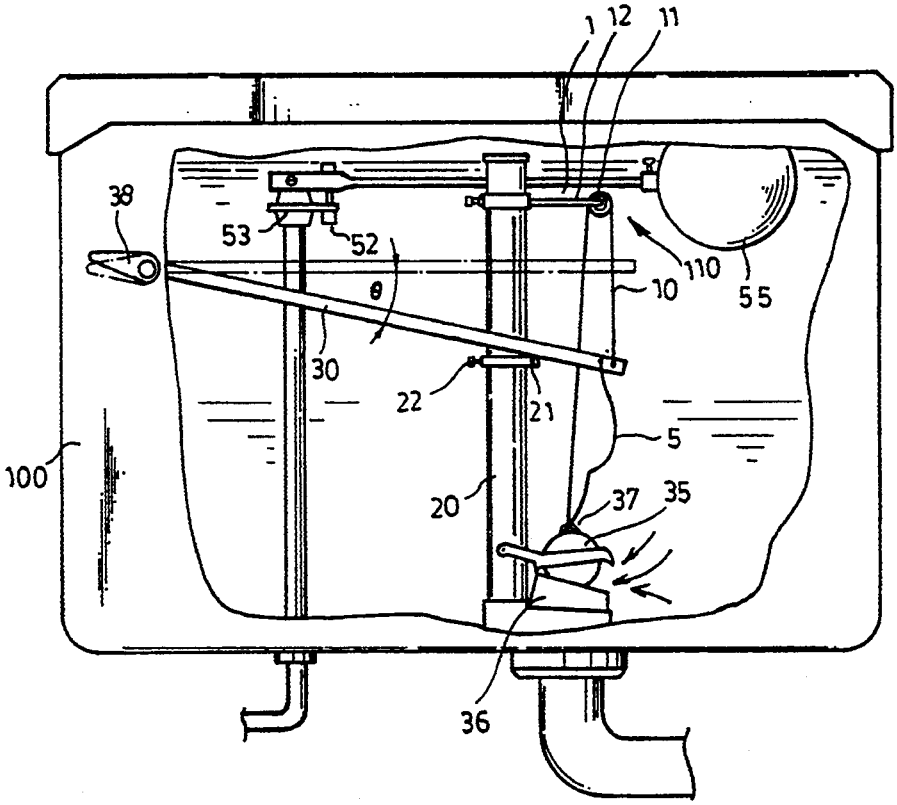
FIG. 2 is a schematic diagram of the elements of this invention.
Figure 3:
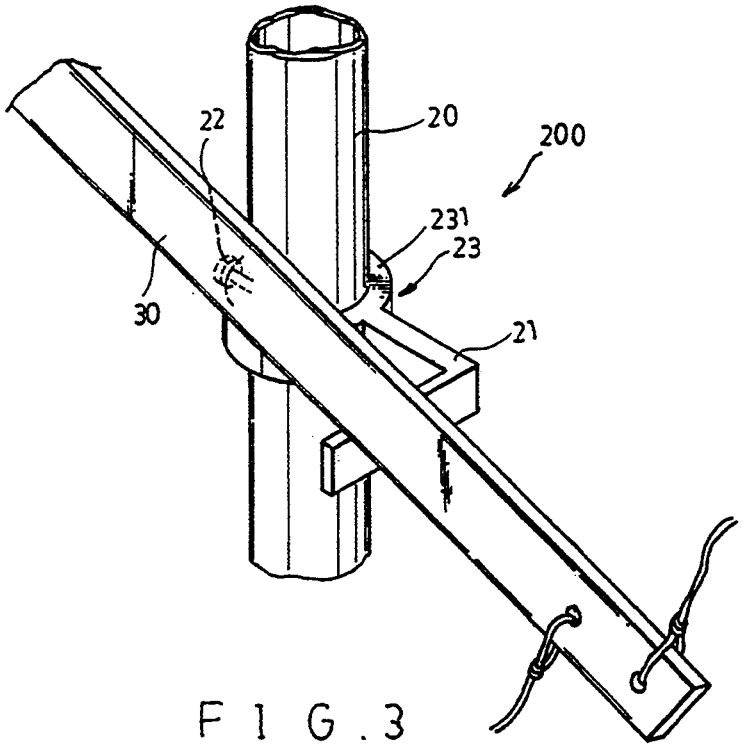
FIG. 3 is a perspective view of an angular restrainer as a lever restraining means.
Figure 4:
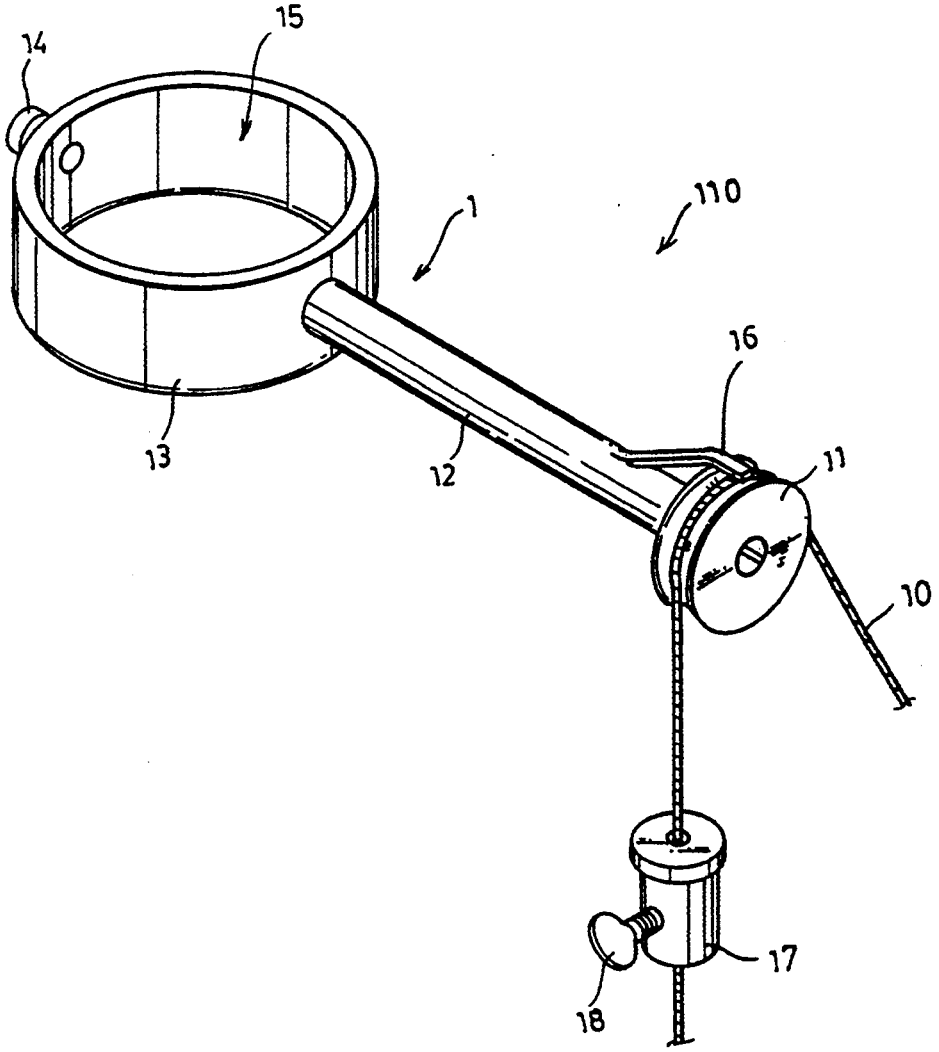
FIG. 4 is a perspective view of a support guide and a robe stopper as a lever restraining means.

With reference to FIGS. 2–4 of the drawings, a preferred embodiment of the flush device for water closets of the present invention comprises a rectangular water tank 100 having an overflow tube 20, a flush lever 30, a flapper ball 35, a connecting means 110 for suspending the flapper ball 35 and a lever restraining means 200 enclosed therein. A handle 38 is connected to one end of the flush lever 30.

The connecting means 110 comprises a support guide 1, a pulley 11 and a long robe 10. The support guide 1 has a ring member 13 being affixed on an overflow tube 20 and a rod member 12 attached to the ring member 13. One end of the rod member 12 is connected to the pulley 11 by the screw for the sliding motion of the long robe 10 and has a fork means 16 having one end integrally extended from an upper periphery of the rod member 10 and the other end abutted the upper circumference of the pulley 11 to prevent the long robe 10 from sliding off the pulley 11. The long robe 10 is looped onto the pulley 11 and has the on one end connected to the flapper ball 35 and the other end connected to one end of the flush lever 30. The short robe 5 is also connected on one end to the flapper ball 35 and the other end to this end of the flush lever 30. The flush lever 30 lifts the flapper ball 35 via the robes 10 and 5. (FIG. 2)

The lever restraining means 200, as shown in FIG. 3, limits the span of the movement of the flush lever 30 that in turn restrains via the long robe 10 the extent to which the flapper ball 35 is raised in order to achieve the function of a multi-staged flush means.

The position of the support guide 1 can be adjusted. As the long robe 10 and short robe 5 are connected to the end of the flush lever 30, the position of the support guide 1 can be moved up along the overflow tube 20 until the long robe 10 becomes barely tight to maintain an appropriate water level when the handle 38 is lifted, as shown in FIG. 2.

When the handle 38 is returned to the normal position, the flush lever 30 is raised and the short robe 5 hence lifts the flapper ball 35 allowing water to discharge into a toilet bowl (not shown).

Because the flapper ball 35 is filled with air, it tends to float at a certain water level and allows the biggest discharge of flush water; when the water level in the tank 100 runs low, the weight of the flapper ball 35 cause the flapper ball 35 to drop down and close a discharge opening 36 to refill the tank 100.

When the handle 38 is moved upward, the flush lever 30 moves downward, pulling up the flapper ball 35 via the long robe 10 and pulley 11. Since the downward movement of the flush lever 30 is limited by the lever restraining means 200, the flapper ball 35 is not completely lifted for full discharge, thus desirably resulting in smaller amount of water being discharged for flush.

Further, the time of discharge can be controlled by holding onto the handle 38 until sufficient flush is accomplished. Under such circumstances, because the water level is low, a float ball 55 activates a ball cock 53 and water fills into the tank 100 and discharges into the bowl continuously. When the handle 38 is let go, the flapper ball 35 drops at a certain low water level and closed the discharge opening, replenishing the water in the tank 100.

Figure 5:
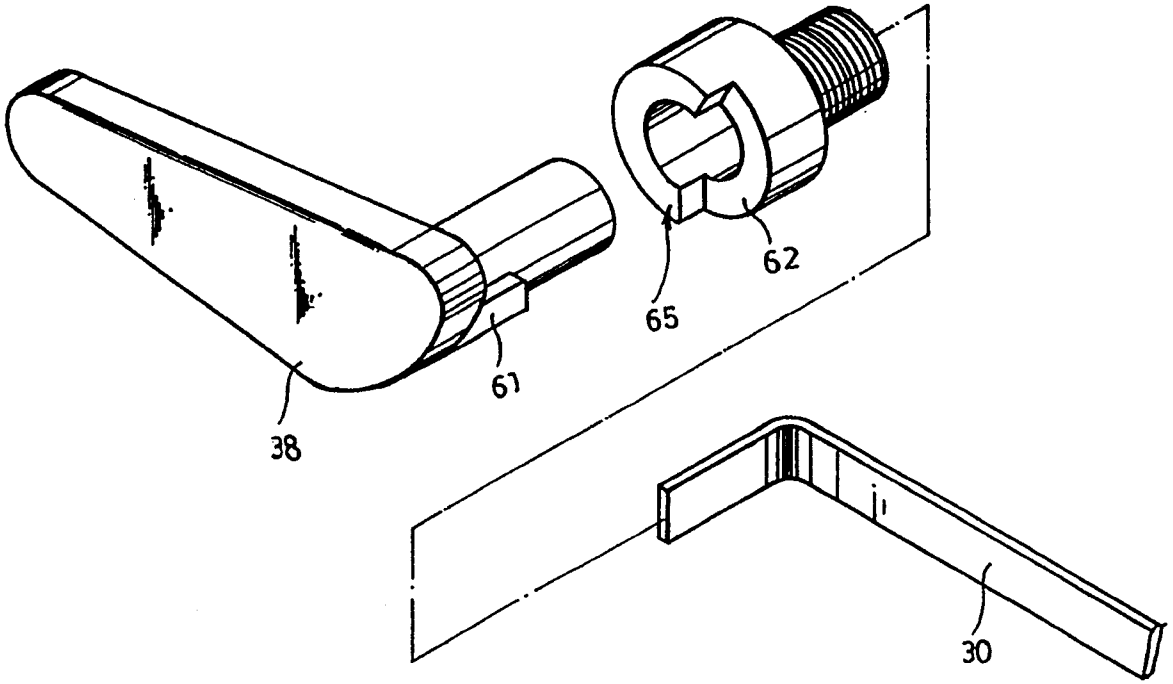
FIG. 5 is a perspective view of a handle as a lever restraining means in relation to the other elements of the present invention.
Figure 6:
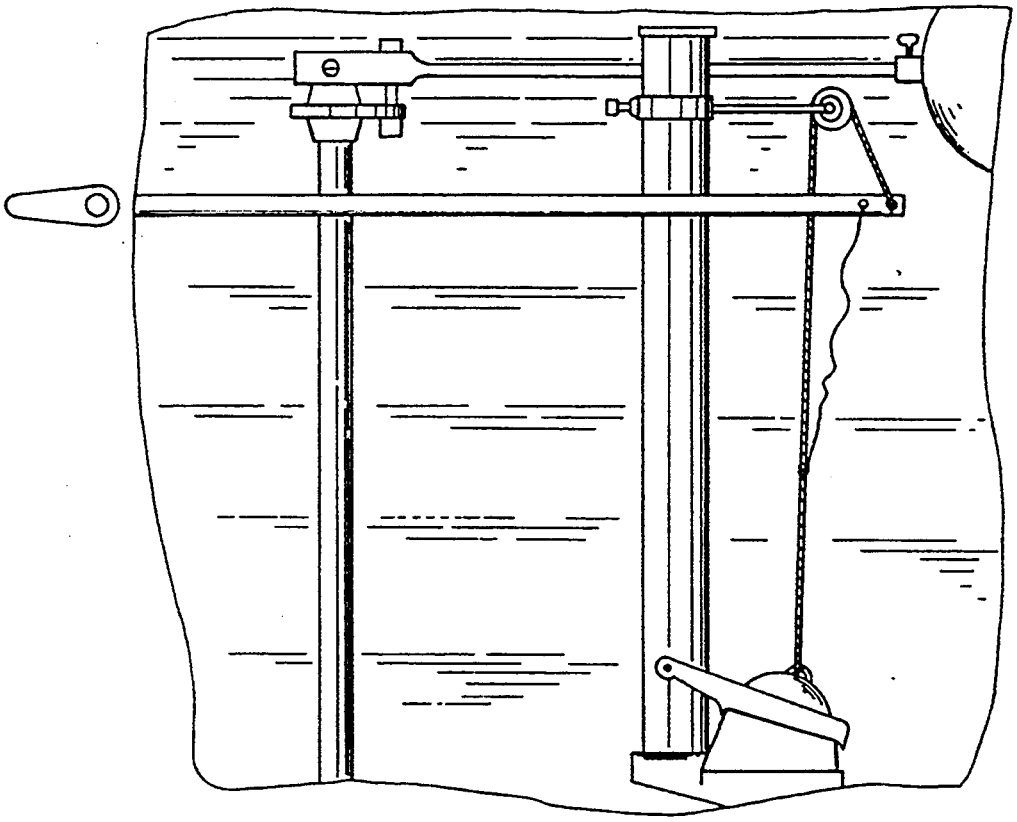
FIG. 6 and 7 are schematic diagrams of the connecting means of the present invention.
Figure 7:
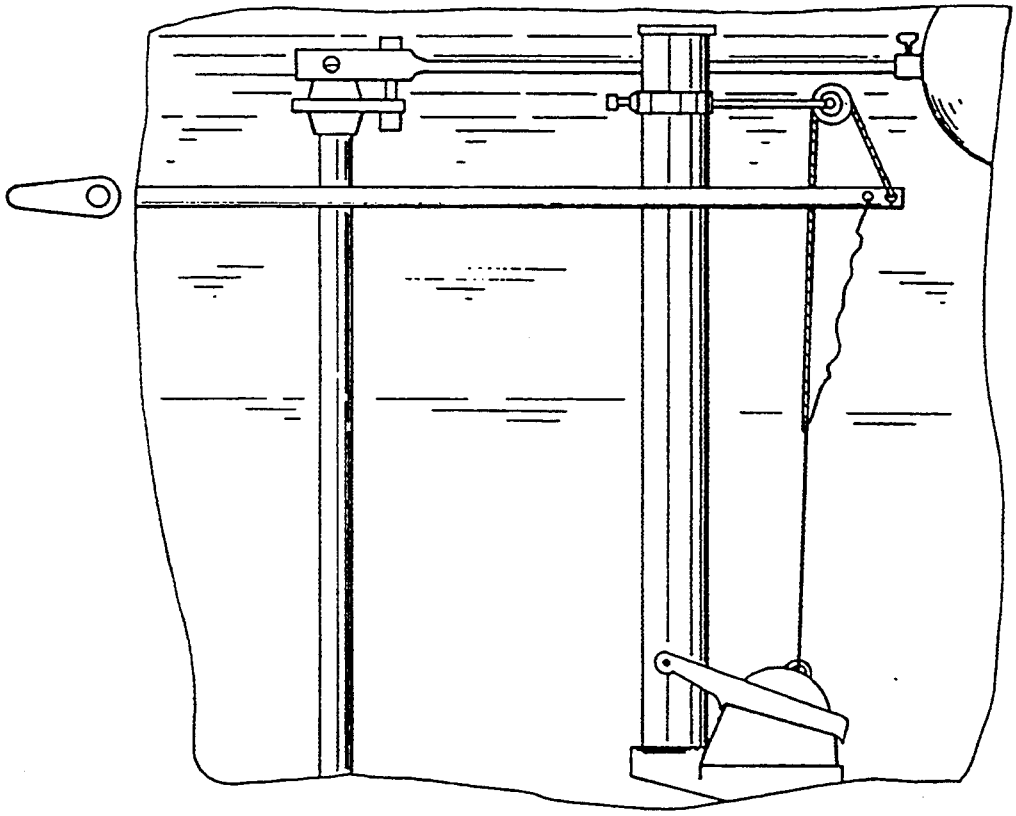

Referring to FIGS. 2 and 5, a preferred embodiment of the present invention has the handle 38 thru a wall of the water tank 100 connected to a first end of the flush lever 30, the long robe 10 and short robe 55 having their first ends connected to a second end of the flush lever 30, the flapper ball 35 connected at its seam 37 to the second ends of the long robe 10 and short robe 5, the ball cock 53 having at its top a fill opening 52 and the float ball 55 connected to the ball cock 53 for controlling water supply.

Referring to FIG. 3, the lever restraining means 200 is in the form of an angular restrainer. 23 having a ring connector 231 attached to an overflow tube 20, a right-angled stop rod 21 connected at a first side of the ring connector 231, and a positioning screw 22 secured to a second side of the ring connector 231. By adjusting the level and direction of the angular restrainer 23, the span of movement of the flush lever 30 can be limited to control the amount of flush water discharged by the flapper ball 35.

For normal use and maximum discharge, the handle 38 is pulled down to lift the flush lever 30 that in turn lifts, via the short robe 5, the flapper ball 35 to its highest suspending position. When the water level drops to a certain extent, the weight of the flapper ball 35 causes the flapper ball to drop down and thus close the discharge opening to refill the tank 100.

For small flush, the handle 38 is pulled up to lower the flush lever 30 that in turn lifts the flapper ball 35 via the pulley 11 and long robe 10. Since the downward movement of the flush lever 30 is limited by the angular restrainer 23, the flapper ball 35 is only slightly raised and can immediately drop down to close the discharge opening when the handle 38 is let go. Thus the amount of flush water can be adjusted manually.

Referring to FIG. 4, the function of the connecting means 110 is further achieved by a robe stopper 17 which is fastened to certain position of the long robe 10 by a fastening screw 18; the extent to which the flapper ball 35 is raised is limited by the position of the robe stopper 17 when the robe stopper 17 is caught by the fork means 16.

Referring to FIG. 5, the function of the lever restraining means 200 is cooperatively achieved by a specially designed handle 38 which has a protruding stopper wing 61 coupled with a restraining notch 62 on its handle nut 65, thus limiting the span of movement of the flush lever that eventually controls the amount of flush water discharged.

Note that various modifications and variations may be made by those skilled in the arts without aparting from the spirit or the scope of the invention as defined in the appended claims and their legal equivalents.

What is claimed is:

1. A flush device for a water closet comprising a rectangular water tank having an overflow tube, a flush lever, a handle pivotally connected to an exterior side of said tank and connected to a first end of the flush lever, a flapper ball providing a selective closure for a discharge opening in said tank and a connecting means for connecting said flapper ball to a second end of said flush lever;

said connecting means comprising rod member having a first end connected to a ring member adapted to be affixed to said overflow tube and a second end connected to a circular pulley having a circumferential track formed, a long robe being looped onto said pulley about said track and having a first end adapted to be connected to said flapper ball and a second end adapted to be connected to said second end of said flush lever, a short robe having a first end adapted to be connected to said flapper ball and a second end adapted to be connected to said second end of said flush lever, and a fork means integrally extending from an upper periphery of said rod member with a fore end of said fork means abutting an upper circumferential periphery of said pulley for preventing said long robe from sliding off of said pulley and a robe stopper intermediate said first end of said long robe and said pulley displaceably fastened to said long robe for selectively abutting said pulley and fork means upon actuation of said handle to limit a lifting span of said flapper ball;

whereby said flush device is operable by said flush handle in a first direction and a second opposite direction wherein operation of said handle in said first direction lifts said flapper ball via said short robe for discharging a normal amount of flush water from said tank and operation of said handle in said second direction lifts said flapper ball via said long robe such that said robe stopper abuts said pulley and fork means thereby restraining movement of said flush lever and limiting the lifting span of said flapper ball for discharging a controlled amount of flush water from said tank less than said normal amount.

* * * * *